US007161303B2

(12) United States Patent
Park et al.

(10) Patent No.: US 7,161,303 B2
(45) Date of Patent: Jan. 9, 2007

(54) PLASMA LIGHTING SYSTEM AND BULB THEREFOR

(75) Inventors: Byeong-Ju Park, Seoul (KR); Joon-Sik Choi, Seoul (KR); Yong-Seog Jeon, Gyeonggi-Do (KR); Hyun-Jung Kim, Seoul (KR); Ji-Young Lee, Gyeonggi-Do (KR); Yun-Chul Jung, Gyeonggi-Do (KR)

(73) Assignee: LG Electronics, Inc., Seoul (KR)

( * ) Notice: Subject to any disclaimer, the term of this patent is extended or adjusted under 35 U.S.C. 154(b) by 99 days.

(21) Appl. No.: 10/752,498

(22) Filed: Jan. 8, 2004

(65) Prior Publication Data

US 2005/0052140 A1 Mar. 10, 2005

(30) Foreign Application Priority Data

Sep. 8, 2003 (KR) ..... 10-2003-0062733
Dec. 13, 2003 (KR) ..... 10-2003-0090971

(51) Int. Cl.
*H01J 17/20* (2006.01)

(52) U.S. Cl. ..... 313/637

(58) Field of Classification Search ..... 313/637–643
See application file for complete search history.

(56) References Cited

U.S. PATENT DOCUMENTS 3,234,421 A 2/1966 Reiling
3,772,557 A * 11/1973 Yoshida et al. ..... 313/639
3,786,297 A 1/1974 Zollweg et al.
4,027,190 A * 5/1977 Shintani et al. ..... 313/639
4,672,267 A 6/1987 Lapatovich et al.
5,905,342 A * 5/1999 Mimasu et al. ..... 315/39
5,952,768 A 9/1999 Strok et al.

FOREIGN PATENT DOCUMENTS

| | | |
|---|---|---|
| EP | 0949658 A2 | 10/1999 |
| EP | 1439568 A2 | 7/2004 |
| FR | 1322463 | 3/1963 |
| JP | 58-025071 | 2/1983 |
| JP | 60-158545 | 8/1985 |
| JP | 09-237608 | 9/1997 |

OTHER PUBLICATIONS

KR office action dated May 30, 2005.
KR Office Action dated Sep. 29, 2005.
EP Search Report Sep. 9, 2005.

* cited by examiner

*Primary Examiner*—Joseph Williams
(74) *Attorney, Agent, or Firm*—Fleshner & Kim, LLP

(57) ABSTRACT

An improved plasma lighting system is provided which includes a bulb filled with both metal halide and mercury as primary light-emitting materials. By maintaining an operating pressure of the metal halide at between approximately 0.1 and 10 atm, and an operating pressure of the mercury at between approximately 30 and 150 atm, a point source of light characteristic and a spectrum characteristic of the emitted light is improved. Therefore, the plasma lighting system can be applied to an optical system that requires a point source of light, and can maximize lighting efficiency to provide improved overall emission characteristics.

14 Claims, 5 Drawing Sheets

PLASMA LIGHTING SYSTEM AND BULB THEREFOR

BACKGROUND OF THE INVENTION

1. Field of the Invention

The present invention relates to a plasma lamp system, and more particularly, to a plasma lamp system and a bulb therefor capable of maximizing lighting efficiency by improving a point source of light characteristic and a spectrum characteristic.

2. Description of the Background Art

In general, a plasma lamp system is a lighting system which emits visible rays and ultraviolet rays when a filling material within a bulb is excited by microwave energy or electric discharge, has a long life span compared to an incandescent lamp or a fluorescent lamp, and has excellent efficiency in lighting.

A bulb of a plasma lamp system is filled with high-pressure mercury or metal halide as a primary light-emitting material leading light-emitting when excited by microwave energy or electric discharge, together with inert gas for forming a plasma at an initial stage of lighting-emitting, additives which make lighting easy and the like.

Such a conventional plasma lamp system shows different characteristics according to types of the primary light-emitting materials within the bulb.

In a UHP (ultra high performance) lamp system having a bulb filled with high-pressure mercury, mercury of about 200 atm or more emits light in operation and shows a spectrum characteristic as shown in FIG. 1. That is, in the UHP lamp system, intensity of light is high in a blue color region where a wavelength of light is about 400~500 nanometers and in a green color region where a wavelength of light is about 500~600 nanometers. But, intensity of light is low in a red color region where a wavelength of light is about 600~700 nanometers. Accordingly, the UHP lamp system cannot obtain high reddish color purity, thereby having limitations on improving display performance.

In an MH (metal halide) lamp system having a bulb filled with metal halide, since intensity of light shows an independent peak in each of red, green and blue color regions, it is easy to make a proper optical spectrum. But, optimum pressure of the metal halide is relatively low because of a characteristic of metal halide, and thus the light is emitted not in parallel but radially, whereby it is not easy to apply the MH lamp system to an optical system that requires a point source of light. Therefore, in case of applying the MH lamp system to an optical system which requires a point source of light, such as a projector or a projection display, as shown in FIG. 2, the center of an arc 40 of a bulb 10 should be positioned at a focal point of a reflector 20 for reflecting light in order to obtain parallel light 30, thereby causing intricacy in manufacturing and degrading productivity.

SUMMARY OF THE INVENTION

Therefore, an object of the present invention is to provide a plasma lamp system and a bulb therefor capable of being optimally applied to an optical system which requires a point source of light and of maximizing its lighting efficiency by improving a point source of light characteristic and a spectrum characteristic of light.

To achieve these and other advantages and in accordance with the purpose of the present invention, as embodied and broadly described herein, there is provided a bulb of a plasma lamp system, filled with both metal halide and mercury as primary light-emitting materials, wherein operating pressure of the metal halide is 0.1~10 atm, and operating pressure of the mercury is 30~150 atm.

To achieve these and other advantages and in accordance with the purpose of the present invention, as embodied and broadly described herein, there is provided a plasma lamp system comprising a magnetron for generating microwave energy; a resonator having a resonant region in which the microwave energy is resonated; and a bulb filled with primary light-emitting materials emitting light when excited by microwave energy resonated in the resonator, wherein both metal halide and mercury are filled in the bulb as primary light-emitting materials, wherein operating pressure of the metal halide is 0.1~10 atm and operating pressure of the mercury is 30~150 atm.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A plasma lamp system emits light when a filling material is excited by microwave energy generated from a magnetron or electric energy supplied from an electricity supply source. The plasma lamp system is classified into an electrodeless lamp system in which light is emitted by plasma generated when microwave energy is applied to an electrodeless bulb, and an electrode lamp system using pair of electrodes for transmitting microwave energy or electric energy to the bulb.

Figure 1:
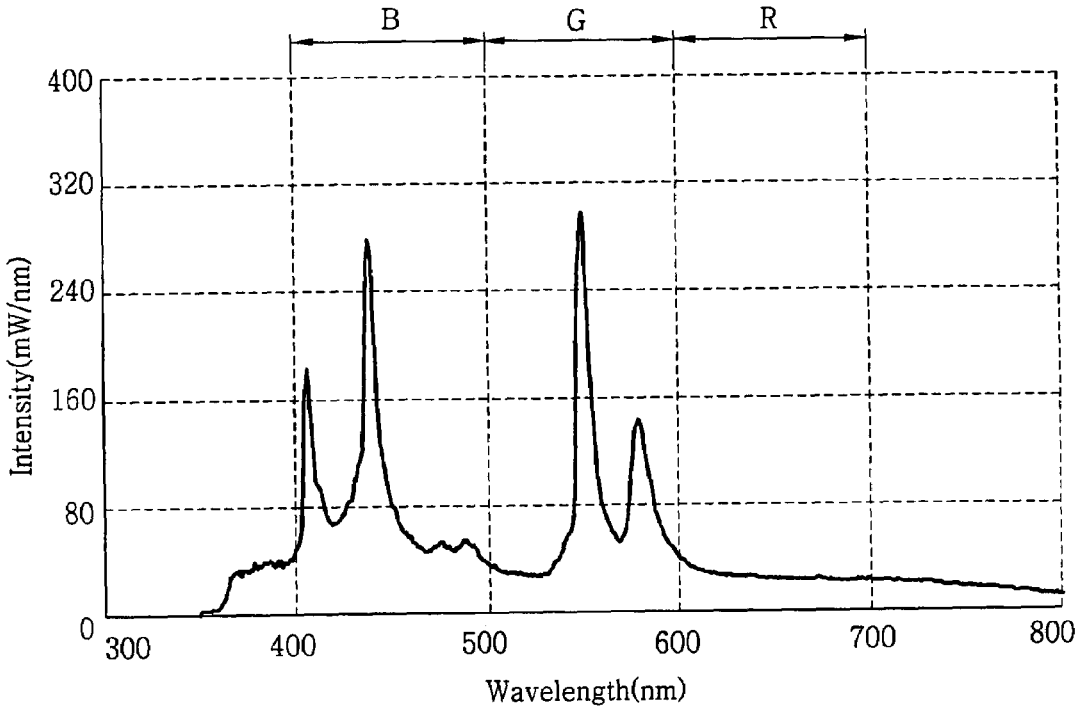
FIG. 1 CONVENTIONAL ART
FIG. 1 is a graph illustrating a characteristic of an optical spectrum of a conventional UHP lamp system.
Figure 2:
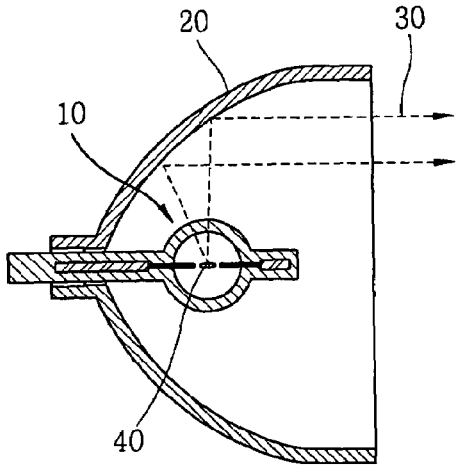
FIG. 2 CONVENTIONAL ART
FIG. 2 is a sectional view illustrating a conventional MH lamp system.
Figure 3:
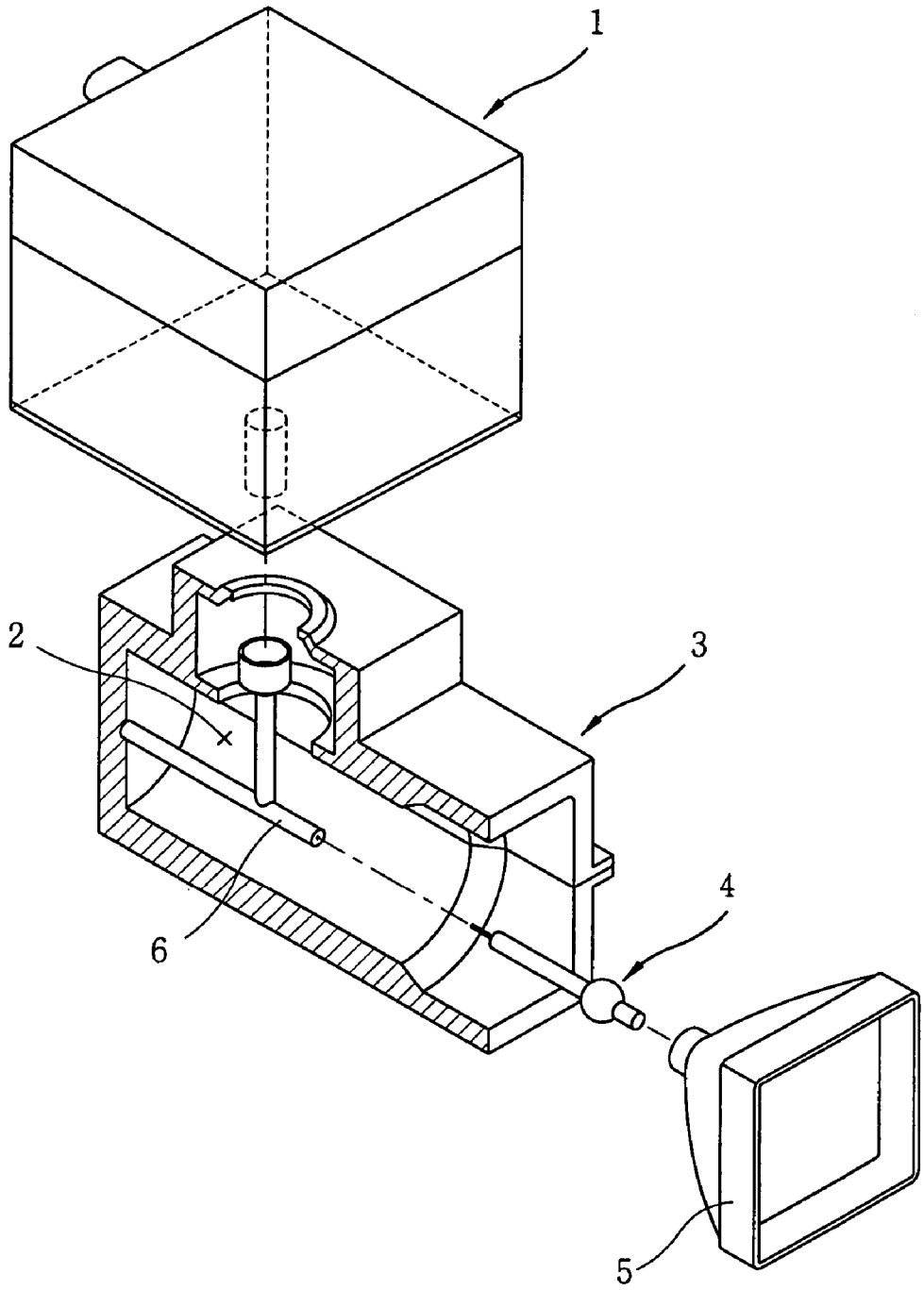
FIG. 3 is a perspective view illustrating a partially cut plasma lamp system in accordance with the present invention.
Figure 4:
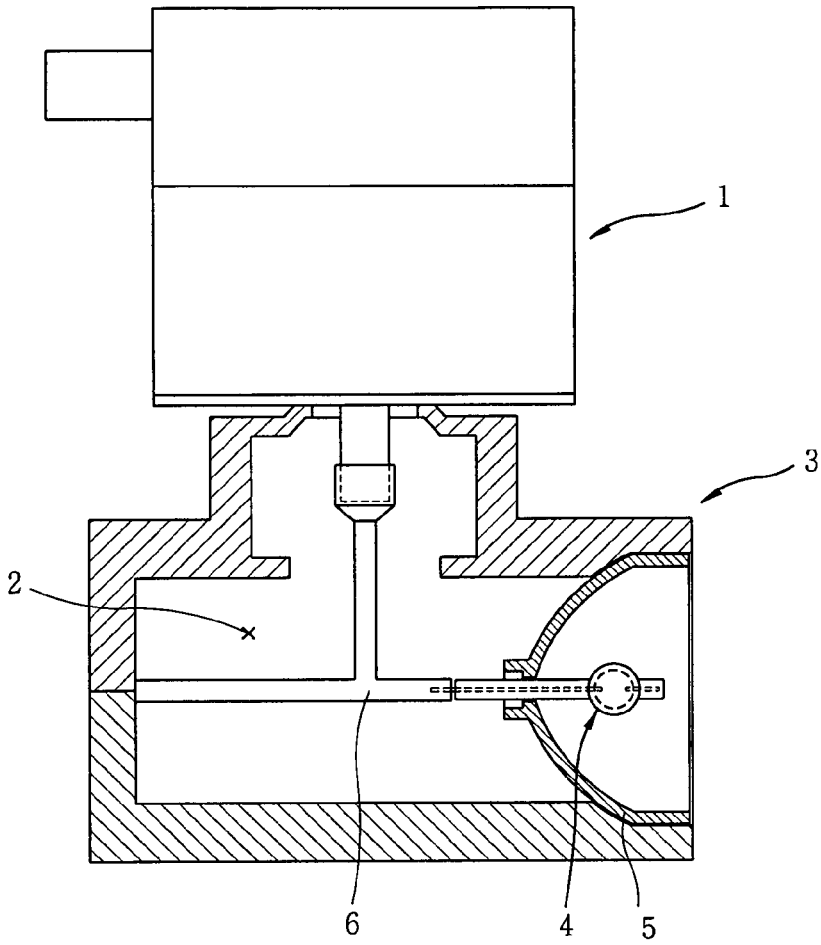
FIG. 4 is a sectional view illustrating a plasma lamp system in accordance with the present invention.

As shown in FIGS. 3 and 4, a plasma lamp system includes a magnetron 1 for generating microwave energy by an external power applied thereto; a resonator 3 connected with the magnetron 1 and having a resonant region 2 in which microwave energy is resonated; a built 4 fixed to one side of the resonator 3 and filled with filling materials which emit light by microwave energy; a waveguide 6 for guiding microwave energy from the resonator 3 toward the bulb 4; and a reflector 5 for reflecting light emitted from the bulb 4.

Figure 5:
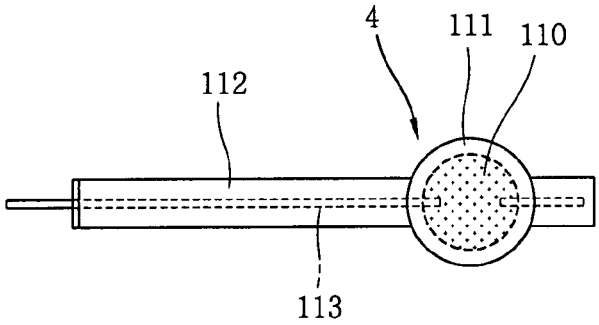
FIG. 5 is a sectional view illustrating a bulb of a plasma lamp system in accordance with the present invention.

As shown in FIG. 5, the bulb 4 includes a spherical light-emitting portion 111 filled with filling materials 110; a bulb stem 112 extended from one side of the light-emitting portion 111 and connected with the waveguide 6; a conductor 113 installed inside the bulb stem 112, connected with the waveguide 6, and guiding microwave energy to the filling materials 110. Preferably, the light-emitting point 111 and the bulb stem 112 are composed of quartz in order to increase optical transmittance thereof and reduce a dielectric loss.

The bulb 4 is filled with metal halide as a primary light-emitting material which leads light-emission when excited by microwave energy, together with materials such as sulfur (S), selenium (Se) or the like, inert gases for forming a plasma at an initial stage of light-emitting, such as argon (Ar), xenon (Xe), krypton (Kr), etc., and an additive for making lighting easy.

In addition, the bulb 4 is filled with high-pressure mercury as a primary light-emitting material for improving a characteristic of point source of light and lighting efficiency. That is, the bulb 4 is filled with both metal halide and high-pressure mercury as primary light-emitting materials, thereby increasing internal pressure of the bulb 4. Accordingly, a spread of emitted light is decreased and the amount of the parallel light is increased, so that such a bulb can be optimally applied to an optical system, which requires a point source of light and parallel light, such as a projector, a projection display and the like.

In addition, the bulb 4 is filled with both metal halide and high-pressure mercury as primary light-emitting materials, whereby a spectrum characteristic of metal halide and a spectrum characteristic of mercury are combined with each other. For this reason, intensity of light is high in a red color region where a wavelength of light is about 600~700 nanometers, and wavelengths of light are uniform in red, green and blue color regions, thereby improving color rendering and lighting efficiency.

Preferably, pressure of metal halide within the bulb 4 is set to be 0.1~10 atm in operation. In case that the operating pressure of metal halide is 0.1 atm or less, the characteristic of metal halide is not shown, and in case the pressure of metal halide is 10 atm or more, the plasma state in the bulb becomes unstable by an ionized halide component. Herein, optimal set pressure of metal halide is 0.5~3 atm, and gallium iodide ($GaI_3$) and strontium iodide ($SrI_2$) are proper as metal halide.

In addition, preferably, pressure of mercury within the bulb 4 is set to be 30~150 atm in operation. In case that the pressure of mercury is 30 atm or less, internal plasma spreads and a point source of light characteristic is weakened, thereby having small effect of filling with mercury, and if the pressure of mercury is 150 atm or more, a spectrum characteristic of metal halide is reduced, and only a spectrum characteristic of mercury is increased, thereby causing degradation in entire spectrum characteristic.

Figure 6:
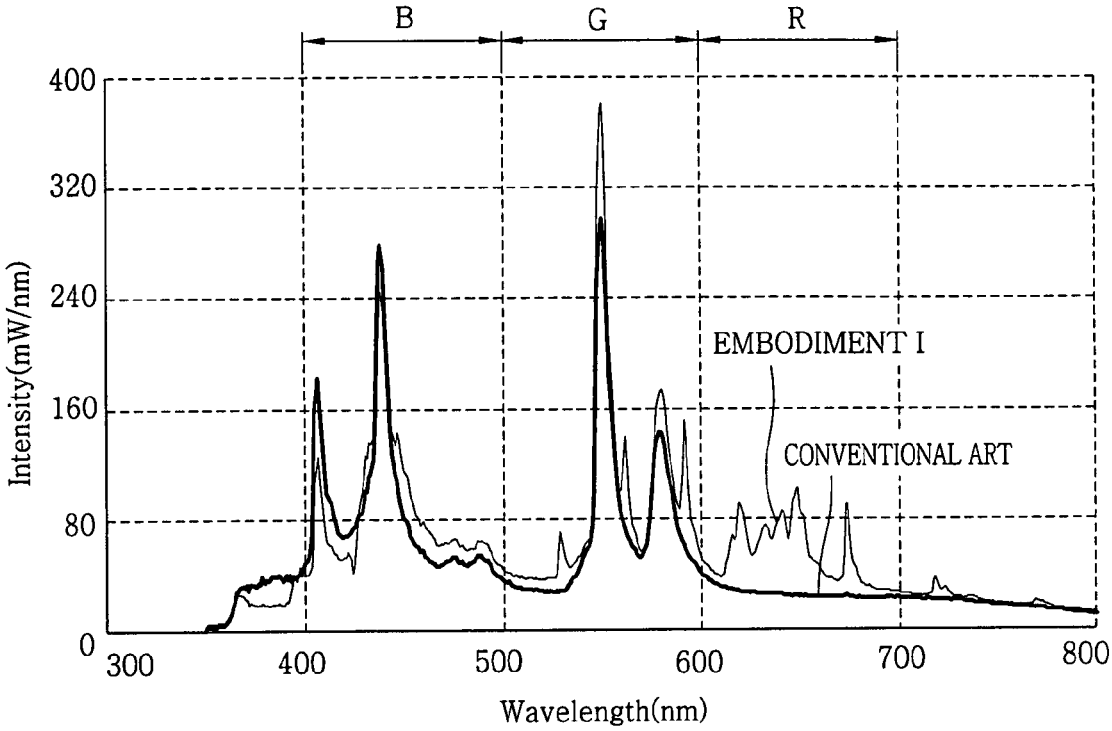
FIG. 6 is a graph for comparing optical spectrum characteristics of a conventional UHP lamp system and a plasma lamp system of the present invention.
Figure 7:
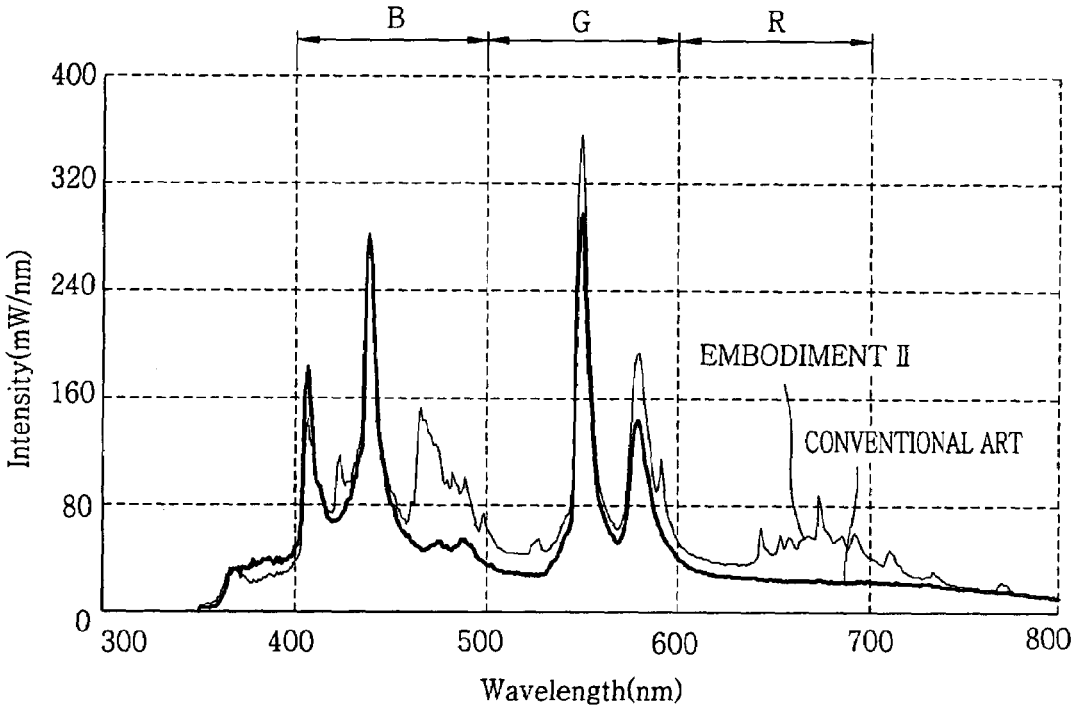
FIG. 7 is a graph for comparing optical spectrum characteristics of a conventional UHP lamp system and a plasma lamp system of the present invention.

FIGS. 6 and 7 are graphs for comparing intensity and a wavelength of light according to a change of types of filling materials within a bulb of a plasma lamp system. The graphs compare optical spectrums of first and second embodiments of the present invention in which a bulb 4 is filled with both high-pressure mercury and metal halide, and gallium iodide ($GaI_3$) and strontium iodide ($SrI_2$) are respectively applied as metal halide, with optical spectrum of a conventional UHP lamp system in which a bulb 4 is filled only with high-pressure mercury of about 200 atm as a primary light-emitting material.

As shown therein, in case of the UHP lamp system in which a bulb 4 is filled only with high-pressure mercury, intensity of light is low in a red color region where a wavelength of light is about 600~700 nanometers. On the other hand, in case of first and second embodiments of the present invention, in which a bulb 4 is filled with both metal halide and high-pressure mercury as primary light-emitting materials, intensity of light is relatively high in a red color region where a wavelength of light is about 600~700 nanometers. And, in case of the first and second embodiments of the present invention, the intensity of light is uniform in an entire wavelength region of light, so that reddish, greenish and bluish light is uniformly emitted.

That is, from FIGS. 6 and 7, it can be known that if a bulb is filled with both metal halide and high-pressure mercury like the first and second embodiments of the present invention, a point source of light characteristic is improved, and also, a spectrum characteristic of metal halide and a spectrum characteristic of high-pressure mercury are combined with each other, thereby improving lighting efficiency. In addition, wavelengths of emitted light are uniform in red, green and blue color regions so that color rendering is excellent and an optimum color ratio of red, green and blue of light is easily implemented.

As so far described, in a plasma lamp system and a bulb therefor in accordance with the present invention, the bulb is filled with both metal halide and high-pressure mercury as primary light-emitting materials, thereby improving a point source of light characteristic and a spectrum characteristic of light. Therefore, a plasma lamp system and a bulb therefor can be optimally applied to an optical system that requires a point source of light and can maximize its lighting efficiency.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A bulb for a plasma lighting system, comprising a light emitting enclosure configured to receive primary light-emitting materials therein, the primary light-emitting materials including a mixture of both metal halide and mercury, wherein the light-emitting enclosure is configured to maintain an operating pressure of the metal halide between approximately 0.1 and 10 atm, and an operating pressure of the mercury between approximately 30 and 150 atm.

2. The bulb of claim 1, wherein an operating pressure of the metal halide is between approximately 0.5 and 0.3 atm.

3. The bulb of claim 1, wherein the metal halide is gallium iodide ($GaI_3$).

4. The bulb of claim 1, wherein the metal halide is strontium iodide ($SrI_2$).

5. The bulb of claim 1, wherein the primary light-emitting materials are excited by microwave energy.

6. The bulb of claim 1, wherein the primary light-emitting materials are excited by electric discharge.

7. A plasma lighting system, comprising:

a magnetron configured to generate microwave energy;

a resonator including a resonant region in which the microwave energy is resonated; and a bulb comprising an enclosure configured to receive a mixture of primary light-emitting materials therein, the bulb being configured to emit light when the mixture of primary light-emitting materials is excited by microwave energy resonated in the resonator, wherein the mixture of primary light-emitting materials includes both metal halide and mercury, and wherein the enclosure is configured to maintain an operating pressure of the metal halide at between approximately 0.1 and 10 atm and an operating pressure of the mercury at between approximately 30 and 150 atm.

8. The lighting system of claim 7, wherein an operating pressure of the metal halide is between approximately 0.5 and 3 atm.

9. The lighting system of claim 7, wherein the metal halide is gallium iodide ($GaI_3$).

10. The lighting system of claim 7, wherein the metal halide is strontium iodide ($SrI_2$).

11. The bulb of claim 1, wherein the mixture of metal halide and mercury is formulated such that both the metal halide and the mercury emit visible light when maintained within an operating pressure of between approximately 0.1 and 10 atm, and between approximately 30 and 150 atm, respectively.

12. A plasma lighting system comprising the bulb of claim 1.

13. The plasma lighting system of claim 7, wherein the mixture of metal halide and mercury is formulated such that both the metal halide and the mercury emit visible light when maintained within an operating pressure of between approximately 0.1 and 10 atm, and between approximately 30 and 150 atm, respectively.

14. The bulb of claim 7, further comprising a reflector configured to reflect light emitted by the bulb, wherein the reflected light is substantially parallel.

* * * * *